United States Patent [19]

Berg

[11] 3,935,935

[45] Feb. 3, 1976

[54] COIN OPERATED LOCKING DEVICE

[76] Inventor: Robert D. W. Berg, 9200 Upton Ave. South, Bloomington, Minn. 55431

[22] Filed: May 5, 1975

[21] Appl. No.: 574,525

[52] U.S. Cl. ..... 194/78

[51] Int. Cl.[2] ..... G07F 17/14

[58] Field of Search ..... 194/78, 54, 59

[56] References Cited

UNITED STATES PATENTS

| | | | |
|---|---|---|---|
| 2,603,334 | 7/1952 | Curren | 194/59 |
| 3,397,765 | 8/1968 | Smith | 194/78 X |

*Primary Examiner*—Stanley H. Tollberg

*Attorney, Agent, or Firm*—Mason, Mason & Albright

[57] ABSTRACT

A coin operated lock includes a casing with collection box and a locking mechanism which is operated by a key. A coin in a receiving pocket of a sliding carriage, connects parts of the mechansim and allows a bolt to be reciprocated upon the rotation of a key. Normally, a spring-biased pawl with ratchet blocks movement of the bolt unless a coin link connection is established that enables the carriage to ride over the ratchet. Upon locking, the key can be removed and the ratchet locks the carriage in extended locked position. Upon turning the key from a locked condition, the pawl is guided to release the carriage and allow return of the carriage with bolt to an unlocked state. The pocket can be adjusted to accommodate any size coin or token. The coin falls by gravity from the pocket to the box which can be locked or latched. The entire device can be easily mounted on the front of most lockers to provide at least minimum security.

12 Claims, 9 Drawing Figures

COIN OPERATED LOCKING DEVICE

This invention relates to a coin operated locking device of the type used on storage lockers wherein a key to the lock can be removed upon the deposit of a coin and when the lock is in locked condition. Upon return of the key and unlocking the lock, the coin is released to a collection box that can be made accessible for the return of the coin to the user or locked with a second lock requiring a different key.

There is a current need for a universal lock that can be fitted on existing lockers such as athletic lockers, storage lockers and other temporary facilities requiring at least minimum security. Examples of such need can be found in transportation terminals, recreation sites and particularly in stores or public areas where free or minimal checking services are provided.

Among the objectives met by the present invention are: the provision of an inexpensive lock that can be readily attached to existing standard lockers; a lock that can be set to accept coins of different diameters or tokens; a lock that has a self-contained coin collection box that can be either locked or left accessible to the user upon the unlocking of the lock and the return of the key.

The above and other objects are achieved with the structure of the locking device disclosed herein and detailed in the drawings in which.

Figure 1:
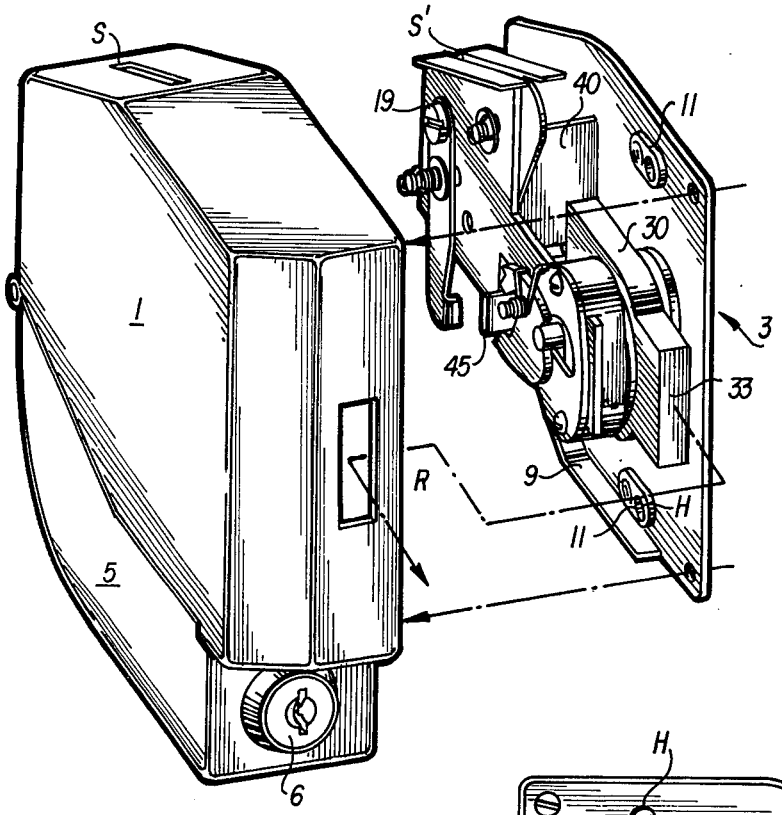
FIG. 1 is a perspective view of the front of the lock and its housing.
Figure 2:
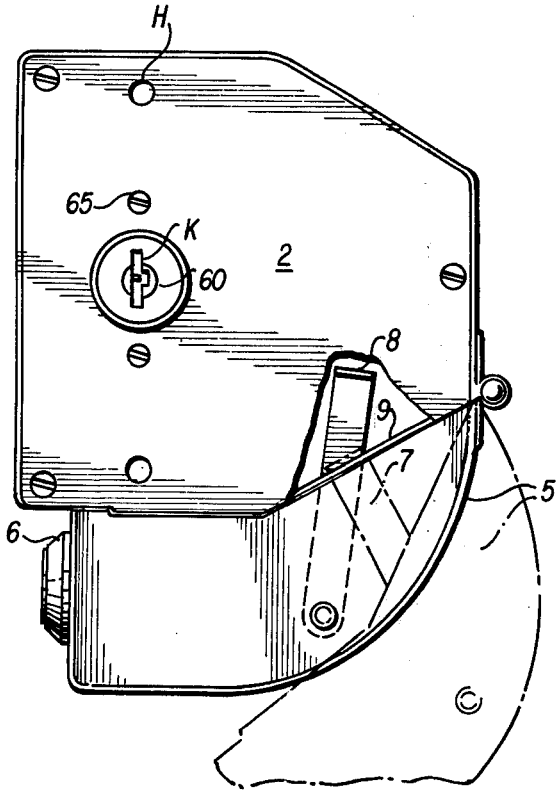
FIG. 2 is a side elevation of the inside of the lock showing the hinged collection box.
Figure 3:
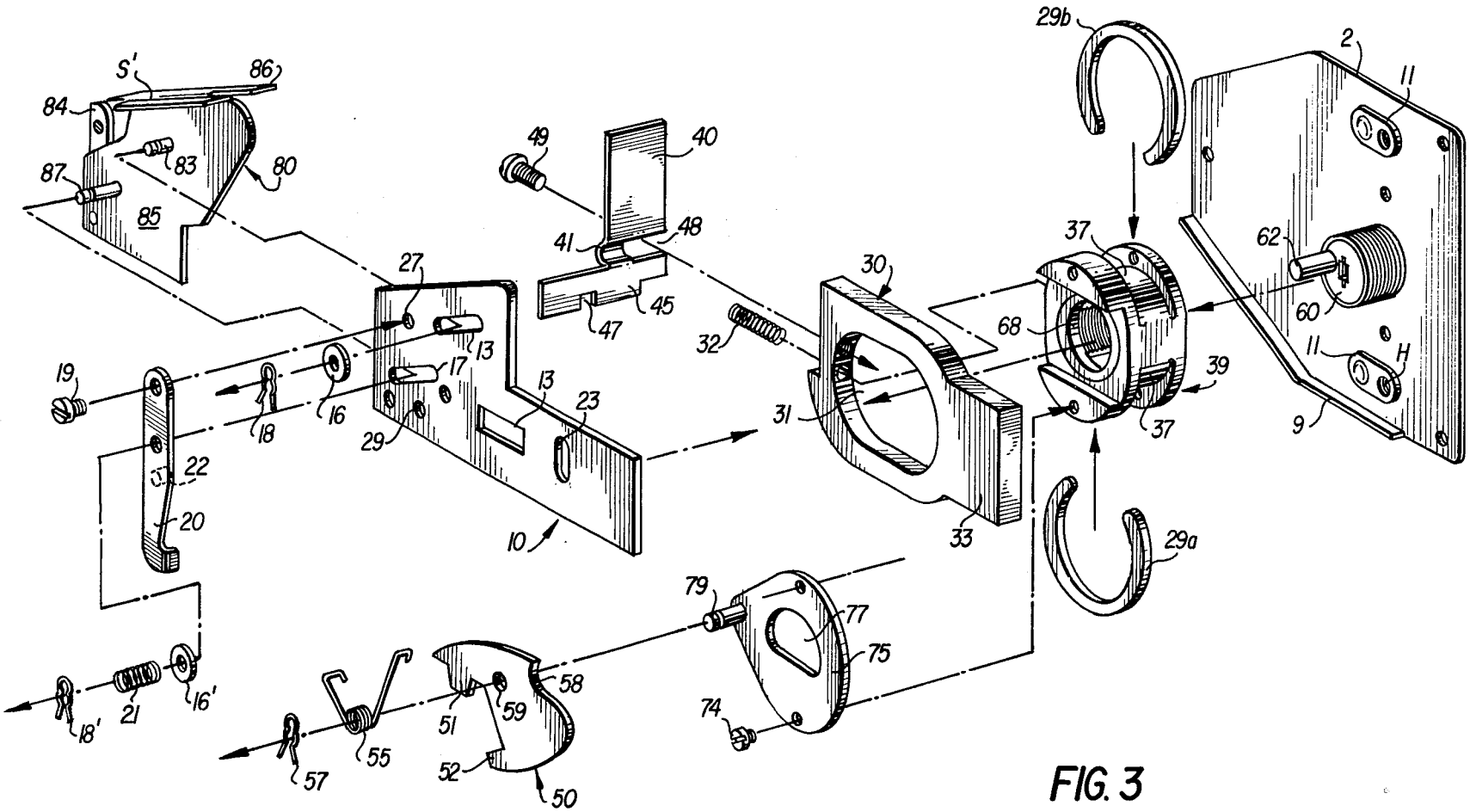
FIG. 3 is an exploded view of the parts of the lock.

In FIG. 1, the housing 1 has a coin slot S and a coin lock mechanism 3 with a further coin slot S′ that registers with that of the housing 1 when the front cover 2 is secured to the housing with peripheral screws as seen in FIG. 2. The housing 1 includes a lower hinged portion 5 that forms a collection box for coins. A pivoted latching arm 7 with a bent over end stop 8 can be swung with the box 5 until the stop 8 catches on rim 9 of cover 2 providing access so that a coin can be removed from the box. A lock 6 at the side of the box 5 is also provided to retain the box 5 in locked condition until authorized collection. Lugs 11 are welded or otherwise affixed to the cover 2 to provide holes H so that the device can be affixed to a locker by means of special screws or rivets.

Basically, the coin mechanism 3 has a coin carriage assembly 80 that slides horizontally as a unit with bolt 30 until stop plate 40 is held by pawl 50 (FIG. 5) preventing locking or until the bolt head 33 is extended to locked position (FIG. 7) after a coin C has been inserted and the lock plug 60 turned 180° by key K.

The coin carriage assembly 80 has a flanged back plate 85 and a flanged front plate 86 with a spacer shim

84 secured by screws between the two plates to leave a coin pocket P that receives a coin C through slot S′. The back plate 85 has two grooved studs 83 and 87 that fit through angled slots 13 and 17 respectively in sliding plate 10. Stud 83 has a washer 16 and circlip 18 to retain the assembly 80 to plate 10 and stud 87 extends through slot 17 of plate 10 as well as the lower aperture of setting lever 20. Studs 83 and 87 secure assembly 80 to plate 10 and stud 87 is fitted with washer 19′, circlip 16′ and compression spring 21.

A screw 19 is loosely passed through the upper aperture of lever 20 and affixed in a screw threaded hole 27 so that pivoting lever 20 about screw 19 moves assembly 80 relative to plate 10 and any one of three or more holes 29 in plate 10 receive stud 22 on arm 20 and afford settings for the assembly 80 which can be adjusted to accommodate coins of three or more different diameters. Unless lever 20 is pivoted, the plate 10 and assembly 80 are moved together when the lock plug 60 is rotated in either direction.

Lock plug 60 has tenon 62 and is fitted in the hole 68 of lock plug housing 39 which is supported on back cover 2 and held in place by a screw 65 on each side of plug 60. The bolt 30 has an enlarged opening 31 that receives the housing 39 so that the perimeter of opening 31 rides on the saddles 37 provided above and below hole 68. Inner and outer shims **29*a* and 29*b* respectively, hold bolt 30 on housing 39, but allow the former to slide along saddles 37**.

Tenon 62 extends through elongated slot 23 of plate 10, and slot 23 is oriented vertically. Rotating plug 60, and tenon 62, moves plate 10 together with assembly 80, back and forth horizontally, whereupon bolt head 33 is placed in unlocked and locked positions accordingly with respect to rectangular bolt slot R of housing 1. The lock plug assembly includes plug 60, housing 39 with shims **29*a* and 29*b*, cover plate 75, pawl 50** and their accompanying parts.

Plate 10 has a forward reduced portion that is slideably received in the recessed face of housing 39. By "forward," it is intended that the bolt 30 with head 33 when extended to locked position is moved in a forward direction.

Figure 8:
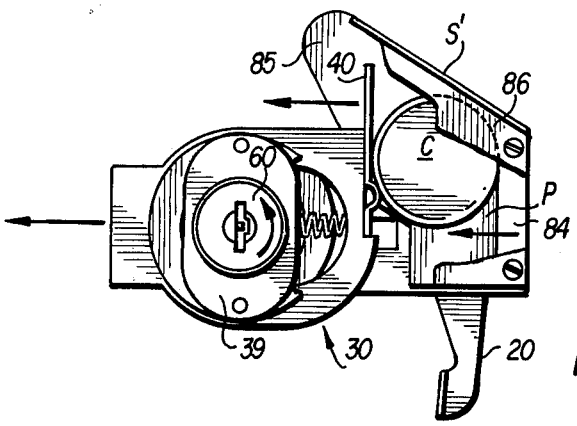
FIG. 8 is an outside elevation of the lock, with parts removed, being operated.

The coin pocket is defined by the opposing sides of plates 85 and 86, shim 84 and a stop plate 40 (FIG. 8). The latter has a beaded head 41 against which a coin rim rests, and latching foot 45 of plate 40 has a notch 47 that rides along the lower edge of elongated slot 13 in plate 10. Screw 49 passes through side notch 48 and is threaded in the upper aperture at the side of bolt 30 to hold plate 40 and bolt 30 together. Compression spring 32 is held in the lower aperture to bear on housing 39 and plate 40 and bias the latter towards shim 84 or the rim of a coin C in the pocket.

A cover plate 75 with a substantially semi-circular hole 77 is secured to the face of housing 39 by screws 74 allowing tenon 62 to extend through hole 77. The perimeter of hole 77 defines a path and stop surfaces for the tenon 62 when plug 60 is rotated by key K. Since tenon 62 also passes through slot 23, it will be appreciated that rotating plug 60 and tenon 62 through an arc defined by the perimeter of hole 77, results in moving plate 10 together with assembly 80 horizontally. The perimeter of hole 77 acts as a stop for tenon 62 in its extreme clockwise and counter clockwise positions.

Cover plate 75 has a pin 79 that affords a pivot about which pawl 50 turns. The pin 79 extends through hole 59 in pawl 50 and receives a spring 55 with retaining circlip 57, the former being fitted to pivot the pawl 50 and bias same about stud 79 counter clockwise as seen in FIGS. 4 – 7. A ratchet 51 on pawl 50 engages the foot 45 of stop plate 40 preventing the plate 10 from sliding beyond the point where foot 45 bears against the extreme left side of slot 13. This action is shown in FIG. 5 and takes place if the plug 60 is turned without a correct coin being inserted in the pocket.

Thus, the pawl 50 prevents plate 10 from sliding horizontally and because bolt 30 is fastened to stop plate 40 by screw 49, any movement of the bolt 30 to a locked position is also arrested and bolt head 33 cannot be extended fully.

Figure 5:
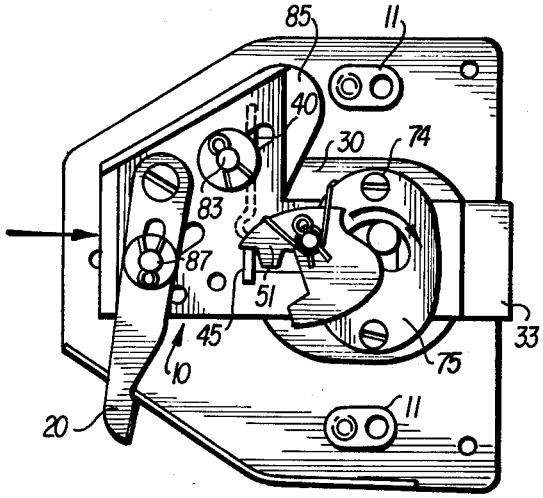
FIG. 5 is an inside elevation of the lock with limited movement and without a coin inserted.
Figure 6:
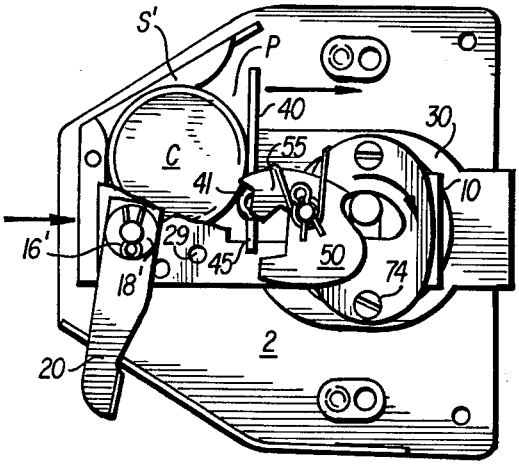
FIG. 6 is an inside elevation of the lock being locked after a coin is placed in the mechanism.

Upon depositing a coin or token of the correct diameter, the rim of the coin bears on the beaded head 41 of stop plate 40 and moves the foot 45 to the right under ratchet 51 as shown in FIGS. 6 and 8 before the same is pivoted clockwise to the FIG. 5 position. The movement of the tenon 62 along the curved surface 58 of pawl 50 prevents the pawl from pivoting counter clockwise to any extent under the influence of spring 55 until the tenon 62 is substantially at the top of hole 77. If a coin is bearing on head 41, the foot 45 will have passed under ratchet 51 before allowing same to fall in the locked position of FIG. 7.

Figure 7:
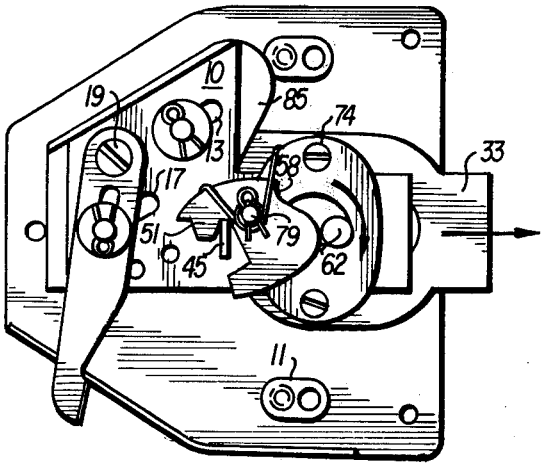
FIG. 7 is an inside elevation of the lock in locked condition.

It will be appreciated that owing to the configuration of hole 77, lock plug 60 is rotatable substantially 180° and key K can only be removed in extreme locked position. Thus, an operator can remove the key when the bolt 30 is in the full locked position of FIG. 7. The ratchet 51 retains latching foot 45 as seen in FIG. 7 until the key K, plug 60 and tenon 62 are turned counter clockwise.

The counter clockwise movement of the tenon 62 moves plate 10 to the left while foot 45, held by pawl 50, slides within slot 13 until coin C falls by gravity out of the open bottom of the pocket. The sliding movement of the plate 10 is transmitted to move shim 84 of assembly 80 to the left to enlarge the pocket. Shim 84 normally bears on a coin rim opposite from beaded head 41 to retain the coin (FIG. 8) so that it can function as a link between assembly 80 and plate 40 with lock 30.

After the coin has dropped to box 5 and the plug 60 turned, tenon 62 swings in a counter clockwise arc to bear on curved surface 58 of pawl 50 and pivot same clockwise about stud 79 and against the bias of spring 55. This pivoting movement of pawl 50 and ratchet 51 releases foot 45, whereupon spring 32 urges bolt 30 to the left in FIGS. 4 – 7 and withdraws bolt head 33 to the position of FIG. 4.

Figure 9:
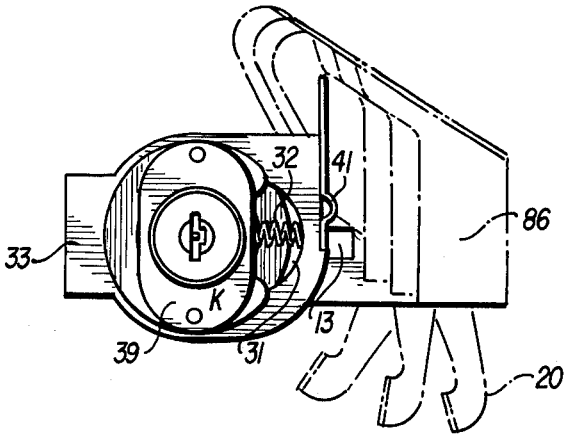
FIG. 9 is an outside elevation of the FIG. 8 lock with the coin set being changed.

The coin setting lever 20 can be set with stud 22 in any one of the three or more holes 29 by lifting lever 20 against the bias of spring 21 which moves shim 84 towards stop plate 40 (FIG. 9). The hole at the extreme left, for example, can be for quarters, the hole at the extreme right for dimes and the intermediate hole can be for nickels. Obviously coins or tokens of any diameter can be accommodated merely by machining holes 29 at the required points in plate 10. A sticker can be affixed on the front of the device to indicate the appropriate coin or token.

Figure 4:
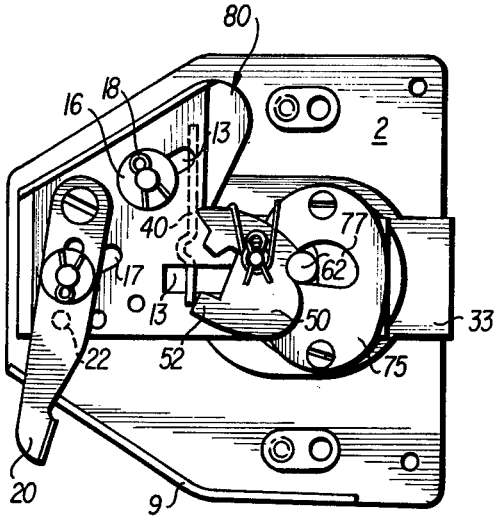
FIG. 4 is an inside elevation of the lock with the bolt retracted.

If a coin larger than the setting is attempted to be inserted in slots S and S′, the pawl foot 52 bearing on foot 45 as shown in FIG. 4, makes it impossible for the device to accept such a coin. A smaller coin than that of the setting would fall by gravity to box 5 making it impossible to lock the device and become captive or if box 5 is left unlocked, the coin could be retrieved.

It will be appreciated that the cover 2 is fastened to the back of a conventional locker door with the lock plug 60 exposed at the front of the door. The remainder of the lock, including the housing 1, is normally located within the locker so that an operator first opens an unlocked door to have access to the storage space, next a coin or token is deposited and the door is closed. The operator then turns and removes the key, locking the door until return.

The above description and drawings disclose several embodiments of the invention. Specific language has been employed in describing the several figures. Nevertheless, it is to be understood that no limitations of the scope of the invention is thereby contemplated for the various alterations and modifications may be made as may occur to one skilled in the art to which the invention relates.

What is claimed is:

1. A coin operated lock device comprising a lock case and a bolt slideably mounted in said case between a sliding plate and a cover, said bolt being horizontally reciprocable to a forward locked direction and to a rear retracted direction responsive to the rotary movements of a lock plug of a lock plug assembly supported on said cover, said plug having a tenon and said tenon extending through slot means in said sliding plate, whereby the rotary movements of the tenon are transmitted to substantially horizontal movements of said plate, a spring-biased pawl being pivoted to said lock plug assembly and a coin carriage assembly being mounted on said sliding plate, a stop plate connected to said bolt and having a horizontal foot that is slideably received in an elongated slot of said sliding plate for limited movement therein, a coin receiving pocket being formed in said carriage assembly with said stop plate at the forward side of the pocket, said pawl having a ratchet that is biased to normally engage the foot of said stop plane and prevent horizontal movement of the stop plate together with the sliding plate and carriage assembly, the foot of said stop plate being positioned to allow said ratchet to ride over the foot when the edge of a coin in said pocket bears on said stop plate and urges same in the forward direction, the diameter of the rim of said coin comprising link means between said carriage and said stop plate, said link means being movable together with the stop plate carriage assembly and lock bolt to the latter's extended locked position in the forward direction by said tenon during rotation of said plug.

2. The device of claim 1, wherein said coin carriage assembly includes a front plate, a back plate and a spacer shim between said front and back plates, said sliding plate having spaced apart oblique slots that receive corresponding studs of said carriage assembly, lever means pivoted to said sliding plate and said lever means being connected to one of said studs whereby pivoting the lever means moves said carriage assembly with respect to both said sliding plate and said stop plate, means for retaining said carriage assembly in any one of a plurality of settings whereby coins of different diameters are accepted in said pocket.

3. The device of claim 1, wherein said lock case has a hinged box positioned below the coin pocket of said carriage assembly and said carriage is movable from a forward position to a retracted position allowing a coin in said pocket to fall by gravity to said box.

4. The device of claim 3, wherein said stop plate has a beaded head that extends in said pocket to engage the rim of a coin and retain same in the pocket.

5. The device of claim 1, wherein said lock plug assembly comprises a key receiving plug rotatably mounted in a locking plug housing which is affixed to said lock case.

6. The device of claim 5, wherein a cover plate with a substantially semi-circular hole is affixed to said plug housing and said tenon is movable along a curved perimeter surrounding the hole in the cover plate when said plug is rotated, said perimeter affording stops that limit the rotations of the tenon and said plug to substantially 180°.

7. The device of claim 6, wherein said cover plate has a pivot and said pawl is turnable on said pivot, said pawl having a curved surface that is engaged by said tenon during rotation of said plug, said pawl being spring biased and said ratchet being urged downwardly into latching engagement with said foot when the bolt is in either a retracted or locked position.

8. The device of claim 5, wherein said bolt has an enlarged opening and said lock plug housing is fitted in said enlarged opening, said bolt being slideable on said housing to a forward locked position and to a rearward unlocked position.

9. The device of claim 8, wherein compression spring means extends through one side of said bolt, said spring means bearing on said stop plate and said plug housing to urge the stop plate and bolt in a rearward retracted direction within said enlarged opening.

10. A coin operated lock device comprising a lock case and a bolt slideably mounted in said case adjacent a sliding plate within said case, said bolt being horizontally movable to a forward locked direction and to a rear retracted direction responsive to the rotary movements of a lock plug assembly of said device, said plug having a tenon and said tenon extending through slot means in said sliding plate, whereby the rotary movements of the tenon are transmitted to substantially horizontal movements of said plate, a spring-biased pawl being pivoted to said lock plug assembly and a coin carriage assembly being mounted on said sliding plate, a stop plate connected to said bolt and having a horizontal foot that is slideably received in an elongated slot of said sliding plate for limited movement therein, a coin receiving pocket being formed in said carriage assembly with said stop plate at the forward side of the pocket, said pawl having a ratchet that is biased to normally engage the foot of said stop plate and prevent horizontal movement of the stop plate together with the sliding plate and carriage assembly, the foot of said stop plate being positioned to disengage with said ratchet and to avoid the foot when the edge of a coin in said pocket bears on said stop plate and urges same in the forward direction, the diameter of the rim of said coin comprising link means between said carriage and said stop plate, said link means being movable together with the stop plate, carriage assembly and lock bolt to the latter's extended locked position in the forward direction by said tenon during rotation of said plug.

11. The device of claim 10, wherein the coin pocket is an elongated slot that extends substantially parallel to the direction of sliding movements of said bolt.

12. The device of claim 11, wherein said casing includes a cover and a housing, said cover having means for attaching the device to a locker door, said housing having a coin slot opening positioned above and in substantial alignment with said pocket.

* * * * *